US008665204B2

(12) United States Patent
Jung et al.

(10) Patent No.: US 8,665,204 B2
(45) Date of Patent: Mar. 4, 2014

(54) BACKLIGHT SPLIT CONTROL APPARATUS AND BACKLIGHT SPLIT CONTROL METHOD USING THE SAME

(75) Inventors: Hyedong Jung, Seoul (KR); Kiman Jeon, Seongnam-si (KR); Hyungsu Lee, Seoul (KR)

(73) Assignee: Korea Electronics Technology Institute, Seongnam-si, Gyeonggi-do (KR)

( * ) Notice: Subject to any disclaimer, the term of this patent is extended or adjusted under 35 U.S.C. 154(b) by 485 days.

(21) Appl. No.: 12/547,611

(22) Filed: Aug. 26, 2009

(65) Prior Publication Data

US 2010/0283802 A1 Nov. 11, 2010

(30) Foreign Application Priority Data

May 8, 2009 (KR) ..... 10-2009-0040447

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 2009/0109165 | A1* | 4/2009 | Park et al. | 345/102 |
| 2009/0115720 | A1* | 5/2009 | Inada et al. | 345/102 |
| 2009/0140975 | A1* | 6/2009 | Nonaka et al. | 345/102 |
| 2009/0174636 | A1* | 7/2009 | Kohashikawa et al. | 345/87 |

FOREIGN PATENT DOCUMENTS

| | | |
|---|---|---|
| KR | 1020060103399 | 9/2006 |
| KR | 1020080078210 | 8/2008 |

OTHER PUBLICATIONS

Office Action dated Oct. 22, 2010 from Japanese Patent Application No. 10-2009-0040447.

* cited by examiner

*Primary Examiner* — Long D Pham
(74) *Attorney, Agent, or Firm* — Lowe Hauptman & Ham, LLP

(57) ABSTRACT

A backlight split control apparatus and a backlight split control method using the same are provided. The backlight split control apparatus, which is a split control apparatus of the backlight divided into a plurality of sections, includes an image signal processor for calculating a section luminance control value which is a representative luminance value of the section, from an image signal; a control signal generator for calculating a backlight control value which is a control signal of the backlight, by correcting a section luminance calculation value using a difference between the section luminance control value and the section luminance calculation value acquired from a section luminance distribution value of a light source of the backlight; and an image signal regulator for adjusting the image signal using the backlight control value.

14 Claims, 6 Drawing Sheets

BACKLIGHT SPLIT CONTROL APPARATUS AND BACKLIGHT SPLIT CONTROL METHOD USING THE SAME

PRIORITY

This application claims the benefit under 35 U.S.C. §119 (a) to a Korean patent application filed in the Korean Intellectual Property Office on May 8, 2009 and assigned Serial No. 10-2009-0040447, the entire disclosure of which is hereby incorporated by reference.

BACKGROUND OF THE INVENTION

1. Field of the Invention

The present invention relates generally to a backlight split control apparatus and a backlight split control method using the same. More particularly, the present invention relates to a backlight split control apparatus and a backlight split control method using the same for regulating an adjustment value of a backlight to an optimal state, enhancing image quality, and raising efficiency of power consumption by adjusting a luminance of the backlight using mutually cooperative luminance information of divided sections of the backlight of a display device.

2. Description of the Related Art

A liquid crystal display device using an element not illuminating by itself, such as a LCD panel, requires a light source like a backlight unit. The conventional display turns on and off the entire backlight, whereas the recent display controls a luminance of the entire backlight for the sake of the reduction of the power consumption. This method can reduce the power consumption by decreasing the luminance in whole but is subject to deterioration of the image quality because the brightness of the entire screen lowers.

After the luminance control technique of the whole backlight, a method for controlling the luminance by splitting the backlight in one dimension and controlling each CCFL has been suggested, which can achieve the better performance than the luminance control of the whole backlight. However, since the physical limitation of the CCFL allows only the one-dimensional control, the adjustment on the detailed area is impossible.

As the backlight of TFT-LCD substitutes the CCFL with an LED, the two-dimensional area division and control of the backlight is feasible. In general, the two-dimensional division control of the backlight is referred to as a backlight local dimming control. The backlight local dimming control divides the backlight into two-dimensional M×N blocks, splits the luminance signal of an input image to match the backlight blocks, extracts the luminance signal within the divided region, and thus controls the luminance. This control method can reduce the power consumption and yield the good performance in terms of the contrast enhancement of the displayed image.

Unlike the adjustment of the luminance of the entire backlight, the method which splits the backlight into the multiple sections and controls the sections individually is subject to the variation of the backlight. Thus, it is necessary to take into account interference between the divided sections in the backlight because the luminance of the neighboring sections affects the luminance of the corresponding section. When the interference is not considered, the accurate backlight value is not calculated. The conventional method determines the luminance of each section of the backlight using merely the value extracted from the luminance distribution of the image without considering the influence from the neighboring sections, and thus suffers from the excessive control or a distortion.

Hence, what is needed is a method for dividing and controlling the backlight with a higher efficiency.

SUMMARY OF THE INVENTION

An aspect of the present invention is to address at least the above mentioned problems and/or disadvantages and to provide at least the advantages described below. Accordingly, an aspect of the present invention is to provide a backlight split control apparatus and a backlight split control method using the same for regulating an adjustment value of a backlight to an optimal state, enhancing an image quality, and raising efficiency of a power consumption by adjusting luminance of the backlight using mutually cooperative luminance information of divided sections of the backlight of a display device.

According to one aspect of the present invention, a split control apparatus of a backlight which is divided into a plurality of sections includes an image signal processor for calculating a section luminance control value which is a representative luminance value of the section, from an image signal; a control signal generator for calculating a backlight control value which is a control signal of the backlight, by correcting a section luminance calculation value using a difference between the section luminance control value and the section luminance calculation value acquired from a section luminance distribution value of a light source of the backlight; and an image signal regulator for adjusting the image signal using the backlight control value. The representative luminance value of the section may be a maximum luminance value or an average luminance value of the section.

When the section representative luminance value is the maximum luminance value of the section, the section luminance control value may be a section maximum luminance value. The section maximum luminance control value may be expressed by the following equation:

$$B_m^{rep} = \max i \mid i \in m\text{-th section}$$

where $B_m^{rep}$ denotes a section maximum luminance control value of an m-th section, and i denotes a luminance value in the section.

The section luminance calculation value may be expressed by the following equation:

$$B_m(x, y) = \sum_{i=m}^{L-1} (b_i G_i(x - x_{mi}, y - y_{mi}))$$

where $B_m(x,y)$ denotes a luminance value at coordinates (x,y) in an m-th section, L denotes the number of LED sections affecting the m-th section, $b_i$ denotes a luminance control value of the m-th section when i=m, and $G_i(x-x_{mi}, y-y_{mi})$ denotes a section luminance distribution value when i=m.

The corrected backlight control value may be expressed by the following equation:

$$b_m^{[n]} = b_m^{[n-1]} + (B_m^{rep} - B^{[n-1]}(x_m, y_m))\rho_m$$

where $b_m^{[n]}$ denotes a luminance control signal value corrected for n times of an m-th section, $b_m^{[n-1]}$ denotes the luminance control signal value corrected for (n−1) times of the m-th section, $B_m^{rep}$ denotes a section maximum luminance control signal of the m-th section, $B^{[n-1]}(x_m, y_m)$ denotes a luminance value at coordinates $(x_m, y_m)$ in the m-th section with the (n−1)-time correction, and $\rho_m$ denotes a weight according to a position of the m-th section.

The split control apparatus may further include a control signal verifier for verifying the backlight control value.

The control signal verifier may verify whether the backlight control value meets the following equation:

$$|B(x,y)-I(x,y)|\leq\epsilon(x,y)$$

where B(x,y), I(x,y) and $\epsilon$(x,y) denote the luminance value at the coordinates (x,y) in the backlight, a required luminance value of an input image signal, and an allowable error value respectively.

The control signal verifier may recalculate the backlight control signal to meet the following equation when |B(x,y)−I(x,y)| is greater than $\epsilon$(x,y):

$$B_m^{rep}=\max(B(x,y)\|B(x,y)-I(x,y)|>\epsilon(x,y),B(x,)\leq I(x,y))$$

where $B_m^{rep}$ denotes an m-th section maximum luminance control value.

According to another aspect of the present invention, a split control method of a backlight which is divided into a plurality of sections includes calculating a section luminance control value which is a representative luminance value of the section, from an image signal; calculating a backlight control value which is a control signal of the backlight, by correcting a section luminance calculation value using a difference between the section luminance control value and the section luminance calculation value acquired from a section luminance distribution value of a light source of the backlight; and adjusting the image signal using the backlight control value. The representative luminance value of the section may be a maximum luminance value or an average luminance value of the section.

The split control method may further include verifying the generated backlight control value. The verifying of the backlight control value can further include determining whether a luminance value at certain coordinates (x,y) in the backlight and a required luminance value of the input image signal exceed an allowable error value. When the luminance value at the certain coordinates (x,y) in the backlight and the required luminance value of the input image signal exceed the allowable error value, the backlight control value may be recalculated using $B_m^{rep}$ which meets the following equation:

$$B_m^{rep}=\max(B(x,y)\|B(x,y)-I(x,y)|>\epsilon(x,y),B(x,)\leq I(x,y))$$

where B(x,y), I(x,y) and $\epsilon$(x,y) denote the luminance value at the coordinates (x,y) in the backlight, the required luminance value of the input image signal, and the allowable error value respectively, and $B_m^{rep}$ denotes an m-th section maximum luminance control value.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments the present invention will become more apparent from the following detailed description taken in conjunction with the accompanying drawings, in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
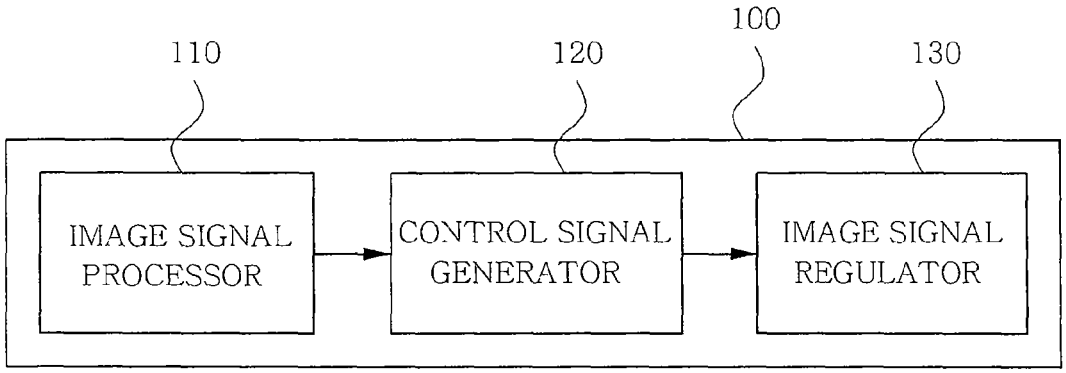
FIG. 1 is a block diagram of a backlight split control apparatus according to an exemplary embodiment of the present invention.

FIG. 1 is a block diagram of a backlight split control apparatus according to an exemplary embodiment of the present invention. The backlight split control apparatus 100 of the present invention is a split control apparatus of the backlight which is divided into a plurality of sections. The backlight split control apparatus 100 includes an image signal processor 110 for calculating a section luminance control value, which is a representative luminance value of the section, from an image signal, a control signal generator 120 for calculating a backlight control value which is a control signal of the backlight by correcting a section luminance calculation value using a difference between the section luminance control value and the section luminance calculation value extracted from a luminance distribution value of a light source of the backlight, and an image signal regulator 130 for adjusting the image signal using the backlight control value.

The backlight split control apparatus 100 including the image signal processor 110, the control signal generator 120, and the image signal regulator 130, calculates the luminance control value per section from the image signal to control the backlight, acquires the control value for controlling the backlight by correcting the section luminance calculation value using the value acquired by comparing the luminance control value with the luminance distribution value of the light source, and thus adjusts the image signal. The backlight split control apparatus 100 modifies the image signal by taking into consideration the influence from the neighboring sections in the backlight divided into the plurality of the sections. The representative luminance value of the section, which is the basis of the control value, can be a maximum luminance value or an average luminance value of the section, or a certain luminance value at a specific position of the section. Hereafter, the section representative luminance value is the section maximum luminance value.

FIGS. 2A through 2D depict the control of the luminance of three adjacent sections in the backlight with a required luminance value. The influence of the neighboring sections onto one section is shown in FIGS. 2A through 2D. That is, the cooperative luminance control in the spatially adjacent three sections is shown. In FIGS. 2A through 2D, rectangles indicate the size and the required luminance of the section of each coordinate.

Figure 2A:
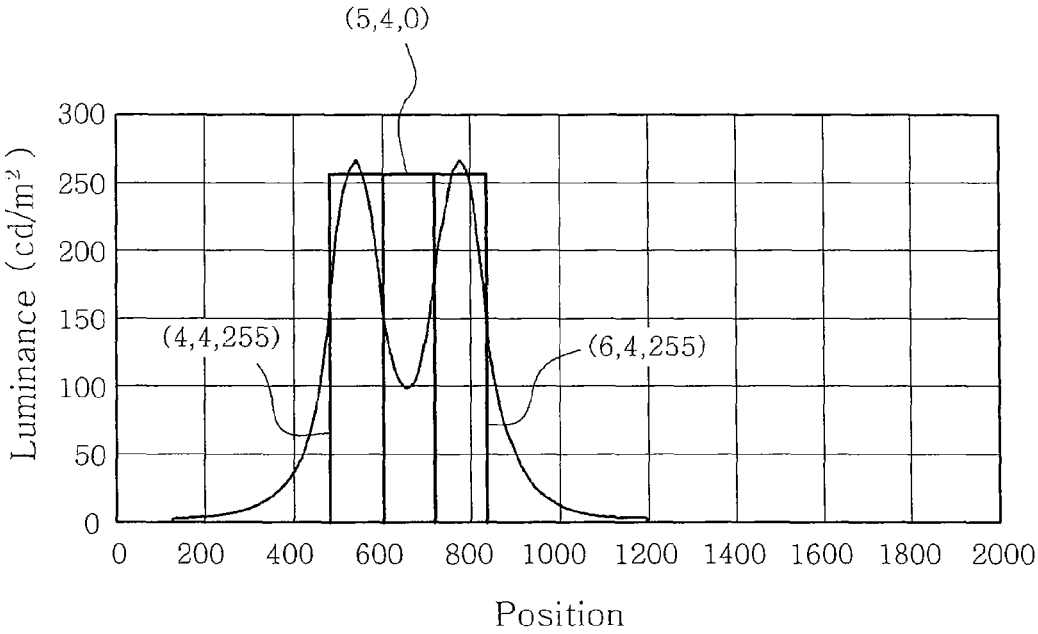
FIGS. 2A through 2D are diagrams of the control of luminance of three adjacent sections in a backlight with a required luminance value.
Figure 2B:
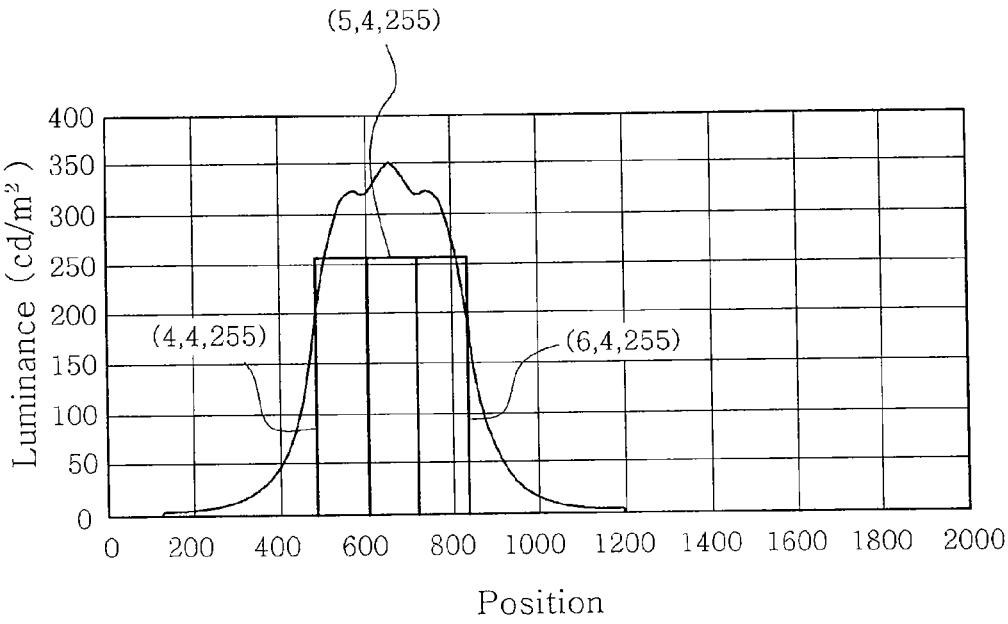

FIGS. 2A through 2D show simulation results of the luminance distribution of the backlight using the luminance distribution of one section in the backlight. In FIG. 2A, when the luminance of the middle section is set to 0 and the luminance of the adjacent sections is set to 255, the luminance of the middle section becomes greater than 0 due to the influence of the adjacent sections. When three consecutive sections each require the luminance of 255 and all of the three sections are controlled with the luminance of 255 as shown in FIG. 2B, uniformity of the luminance distribution of the actual backlight deteriorates and the brighter light than the required luminance is illuminated.

Figure 2C:
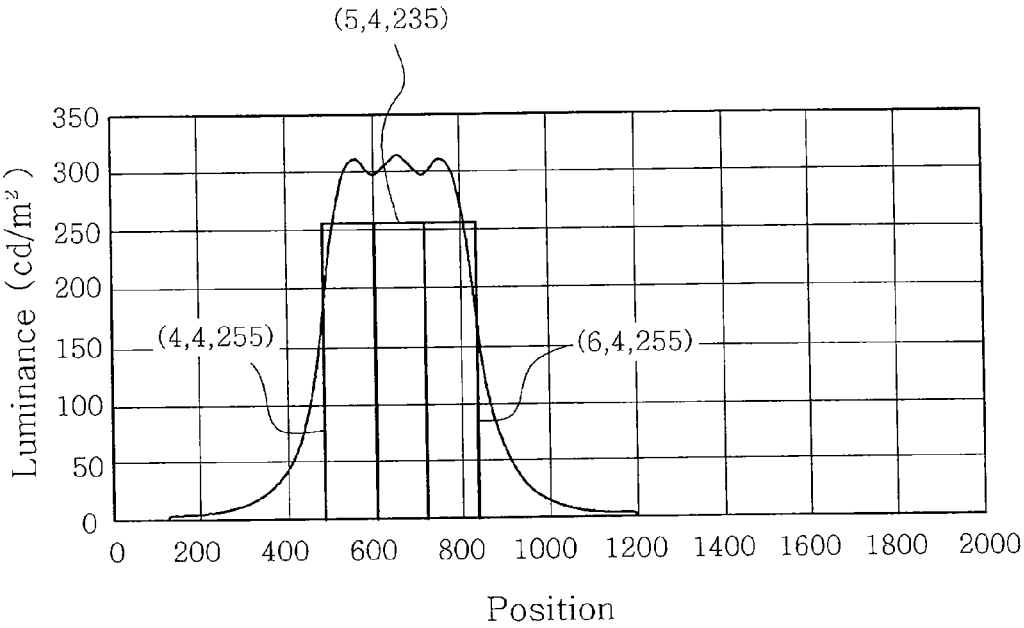
Figure 2D:
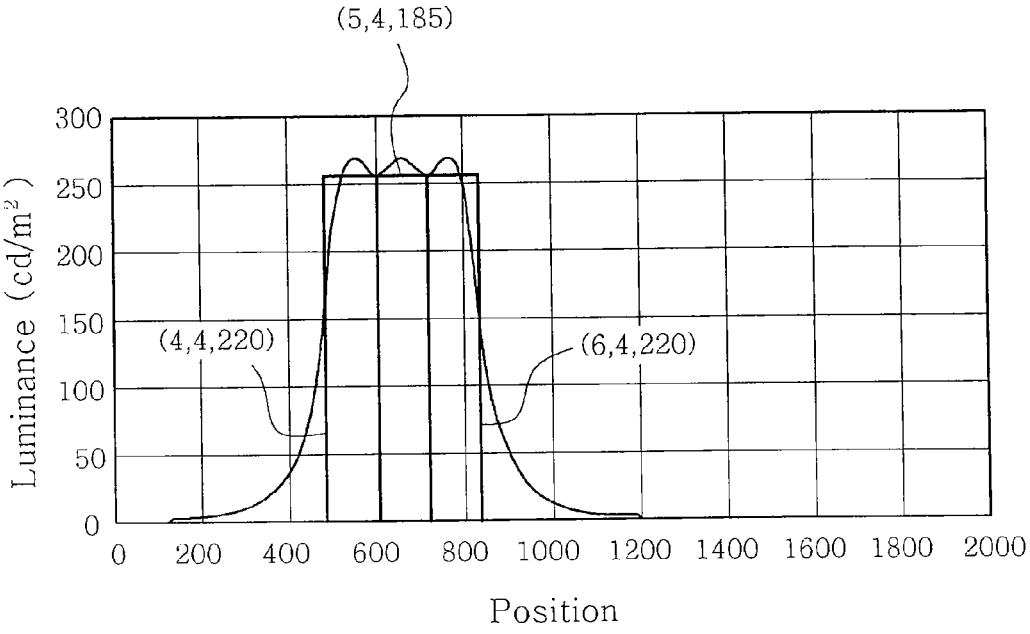

When the control value of the middle section is lowered to 235 to raise the luminance uniformity between the sections, the luminance of FIG. 2C is lower than that of FIG. 2B. In this case, while the uniformity of the luminance is increased, it emits the brighter light than required. Accordingly, when the three sections are controlled with 220, 185 and 220, the luminance uniformity of each section is increased and the luminance value approaches the required luminance as shown in FIG. 2D.

As such, to split and control the luminance of the backlight, it is necessary to modify the input image signal by taking into account the luminance influence from the neighboring sections. Using the backlight split control apparatus 100, the method for controlling the luminance as shown in FIGS. 2A through 2D is calculated and applied based on more accurate equations.

Figure 3:
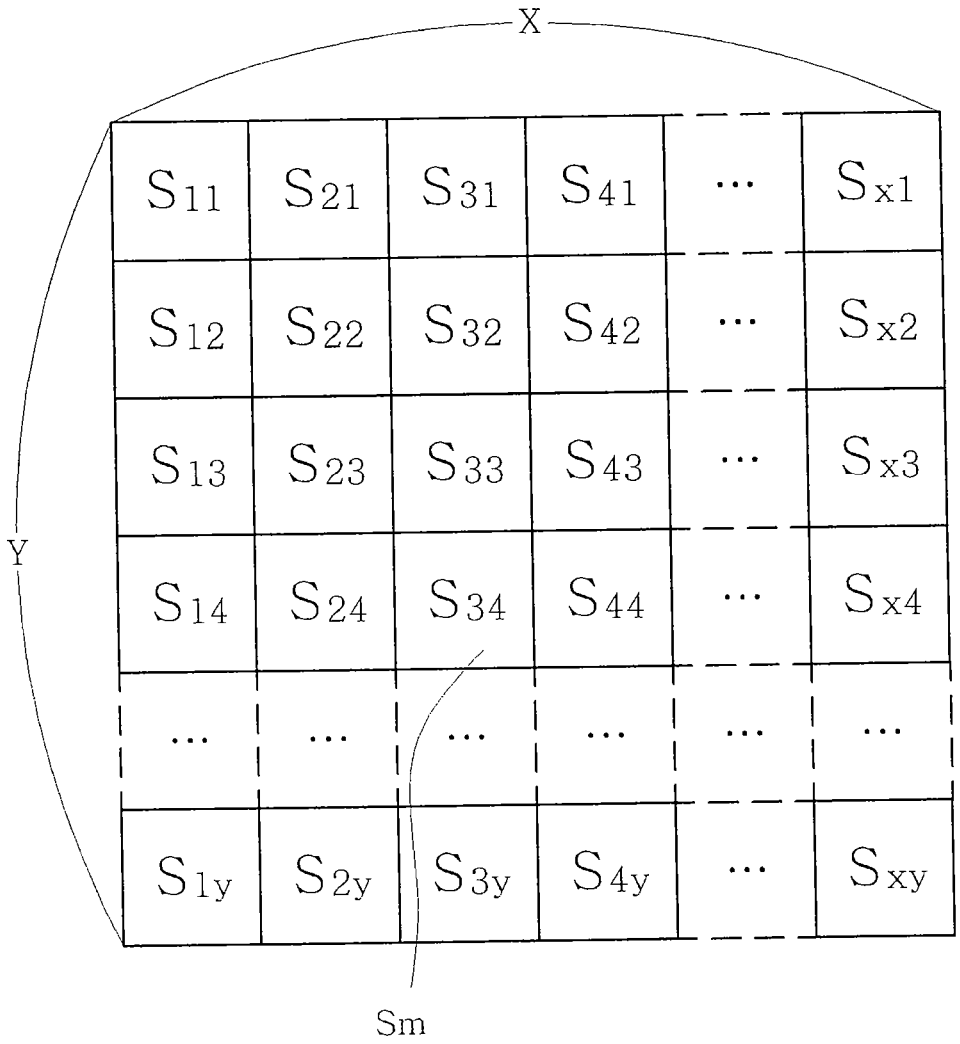
FIG. 3 is a diagram of the backlight divided into x-by-y sections.

FIG. 3 depicts the backlight divided into x-by-y sections. The backlight includes x×y sections from $S_{11}$ to $S_{xy}$. By defining a certain section, for example, the $S_{34}$ section to the m-th section in FIG. 3, the luminance influence of the neighboring sections onto the certain section can be calculated. Hereinafter, a maximum luminance value in the m-th section of FIG. 3 is set and explained.

The image signal processor 110 calculates a maximum luminance value in the section (a section maximum luminance control value), which is the luminance control value for controlling the backlight section, from the input image signal which is to be represented in a display device. The section maximum luminance control value in the section can be given by the following equation.

$$B_m^{rep} = \max i \mid i \in m\text{-th section} \quad \text{[Equation 1]}$$

In Equation 1, $B_m^{rep}$ denotes the section maximum luminance control value of the m-th section, and i denotes the luminance value in the section.

In one section, the maximum luminance part lies at the center of the section and its luminance decreases as receding from the center. Accordingly, to taking into account such distribution, a relative position of the section maximum luminance control value from the section center is stored.

The control signal generator 120 corrects a section luminance calculation value using a difference between the section maximum luminance control value and the section luminance calculation value acquired from the luminance distribution value of the light source of the backlight, and thus calculates a backlight control value which is a control signal of the backlight. That is, the control signal generator 120 calculates a cooperative luminance control signal using position information of every section extracted by the image signal processor 110, examines whether the required luminance is satisfied in every pixel of the input image, and thus generates a final backlight control signal, which shall be described in more detail.

Figure 4:
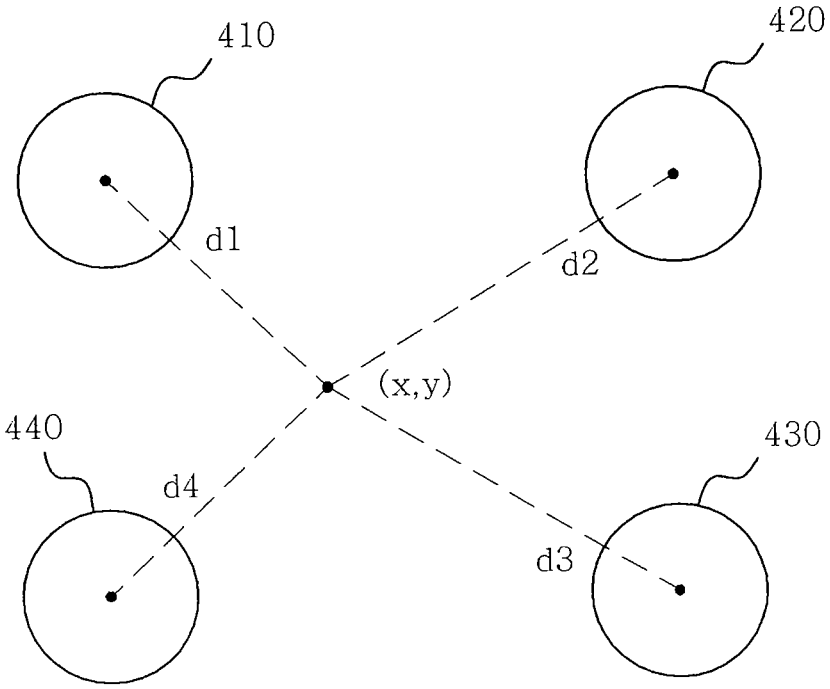
FIG. 4 is a diagram of luminance influence of an LED section to coordinates (x,y) in the backlight.

The control signal generator 120 calculates the section luminance calculation value from the luminance distribution value of the light source of the backlight. The section luminance calculation value can be obtained by computing the luminance distribution of the section based on luminance distribution data of the single LED section in the backlight, or by measuring the luminance of the section. The section luminance distribution value of the m-th section based on a luminance distribution function of the single LED is given by the following equation.

$$G_m(x, y) = \sum_{i=0}^{L-1} g(x - x_{mi}, y - y_{mi}) \quad \text{[Equation 2]}$$

g(x,y) denotes the luminance distribution function of the light source, and L denotes the number of the single LEDs affecting the m-th section. Since the LED module has a bell-shaped luminance distribution based on the center of the module, the luminance degree affected by the corresponding LED module onto the position (x,y) can be acquired based on the distance $(x-x_{mi}, y-y_{mi})$ from the central position $(x_{mi}, y_{mi})$ of the i-th LED section. FIG. 4 depicts the luminance influence of the neighboring LED sections onto the coordinates (x,y) in the backlight.

There are four LED modules 410 through 440 which affect the luminance of the central coordinates (x,y) in FIG. 4. The sum of the luminance distributions at the position $(x-x_{mi}, y-y_{mi})$ away from the center of the first through fourth LED modules by $d_1$, $d_2$, $d_3$ and $d_4$ is the luminance distribution at the coordinates (x,y).

By conducting this process on every position within one section, a luminance distribution value $G_m(x,y)$ in the m-th section can be acquired. Since the luminance distribution data varies per the position of the section, it is necessary to compute the luminance distribution data in every section. Notably, since the characteristics of the luminance distribution data do not change as the time passes by, the computation of the section luminance distribution data is not necessarily continued. For example, the computation can be carried out at the initial phase of the display device manufacture and then utilized continuously.

The control signal generator 120 calculates the section luminance calculation value using the computed section luminance distribution value. The section luminance calculation value, which is the brightness of the backlight, is represented by the sum of the luminance of the corresponding section and the luminance affected by the neighboring sections. More specifically, using the computed luminance distribution value $G_m(x,y)$ of the m-th section, the section luminance calculation value for every section calculated at the image signal processor 110 is given by the following equation.

$$B_m(x, y) = \sum_{i=m}^{L-1} (b_i G_i(x - x_{mi}, y - y_{mi})) \quad \text{[Equation 3]}$$

In Equation 3, $B_m(x,y)$ denotes the luminance calculation value at the coordinates (x,y) in the m-th section, L denotes the number of the LED sections affecting the m-th section, $b_i$ denotes a luminance control value of the m-th section when i=m, and $G_i(x-x_{mi},y-y_{mi})$ denotes the section luminance distribution value when i=m.

$B_m(x,y)$ indicates the section luminance calculation value at the position (x,y), which is the brightness of the backlight. The luminance of the backlight at the position (x,y) is acquired by multiplying the brightness control value ($b_i$ when i=m) of the m-th section by the brightness distribution value ($G_i(x-x_{mi},y-y_{mi})$ when i=m) based on the distance from the center of the section, multiplying the brightness control value ($b_i$ when i≠m) of each neighboring section by the brightness distribution value ($G_i(x-x_{mi},y-y_{mi})$ when i≠m) based on the distance from the center of the section, and adding the two products. L indicates every section witch affects the brightness of the m-th section. Accordingly, the wider brightness distribution of the section, the greater L.

Using the acquired section luminance calculation value, the backlight control value is corrected as below. The corrected backlight control value can be expressed by the following equation.

$$b_m^{[n]}=b_m^{[n-1]}+(B_m^{rep}-B^{[n-1]}(x_m,y_m))\rho_m \quad \text{[Equation 4]}$$

In Equation 4, $b_m^{[n]}$ denotes the luminance control signal value corrected for n times of the m-th section, $b_m^{[n-1]}$ denotes the luminance control signal value corrected for (n−1) times of the m-th section, $B_m^{rep}$ denotes the section maximum luminance control signal of the m-th section, $B^{[n-1]}(x_m,y_m)$ denotes the luminance value at the coordinates $(x_m,y_m)$ in the m-th section with the (n−1)-time correction, and $\rho_m$ denotes a weight according to the position of the m-th section.

$b_m^{[n]}$ indicates the value of the brightness control signal of the m-th section, where the superscript [n] denotes the current stage and the subscript [n−1] denotes the computation result of the previous stage. $B_m^{rep}$ indicates the brightness required by a brightness representative value of the corresponding m-th section as calculated previously. $B^{[n-1]}(x_m,y_m)$ indicates the backlight brightness at the location acquired in the previous stage based on the backlight brightness calculation equation. By adding the difference of the two values, the difference between the backlight brightness acquired in the previous stage calculation and the brightness value required by the image can be corrected.

$\rho_m$ is the weight based on the position of the m-th section. $\rho_m$ implies that the degree of the influence on the neighboring section varies according to the position of the section. Since $\rho_m$ can indicate a ratio of the number of the actually affecting sections to the total number of the sections of the backlight, the weight can be applied by differing the ratio of the actually affecting sections based on the position of the section.

By repeating the backlight control signal calculation as above, the backlight control signal satisfying the brightness required by the input image can be attained. As the number of the repetition of the calculation increases, more accurate control signal can be yielded.

The image signal regulator 130 modifies the image signal using the backlight control value calculated as above; that is, using the backlight control signal. Since the brightness of the backlight section adjusted in accordance with the input image is changed in part relative to the conventional backlight without the brightness control, the transmittance of the display panel for representing the image signal should be changed as well. Since the transmittance of the panel is determined by the input image signal, the input image signal is adjusted. Provided that the brightness of the light viewed to the user is β, the brightness β(x,y) at the position (x,y) is given by the following equation.

$$\beta(x,y)=B(x,y)\cdot\tau(x,y) \quad \text{[Equation 5]}$$

In Equation 5, B(x,y) denotes the luminance of the backlight at the corresponding position, which is determined through the afore-mentioned calculation. τ(x,y) denotes the transmittance of the panel determined by the input image signal, which is a function of the input image I(x,y). The image signal regulator 130 modifies B(x,y) and τ(x,y) such that I(x,y) is equal to β(x,y).

In another exemplary embodiment of the present invention, the backlight split control apparatus can further include a control signal verifier (not shown) for verifying the backlight control signal. The control signal verifier determines whether the backlight control signal meets the following equation or not.

$$|B(x,y)-I(x,y)|\leq\epsilon(x,y) \quad \text{[Equation 6]}$$

In Equation 6, B(x,y), I(x,y) and ϵ(x,y) denote the luminance value at the coordinates (x,y) in the backlight, the required luminance value of the input image signal, and an allowable error value respectively.

ϵ(x,y) is the allowable error value between B(x,y) and I(x,y). The smaller ϵ(x,y), the higher accuracy. Since the control unit of the backlight is greater than the pixel of the input image, the detailed control is impossible. Hence, the allowable error value needs to be applied by taking into account the brightness distribution within the section. When the backlight control signal exceeds the allowable error in the verification, it is necessary to recalculate the brightness control signal with respect to the corresponding section. When the brightness of the backlight is less than the brightness required by the image, the error can be overcome by adjusting the overall image signal in order to maintain uniformity of pixel values. However, as for the considerable difference between the brightnesses, the brightness of the corresponding backlight needs to be increased.

Thus, when the brightness of the backlight acquired through the repetitive computations on the section is less than the brightness required by the image and its difference exceeds the allowable error; that is, when |B(x,y)−I(x,y)| is greater than ϵ(x,y), it is preferable to recalculate the backlight control signal to meet the following equation.

$$B_m^{rep}=\max(B(x,y)\,|\,|B(x,y)-I(x,y)|>\epsilon(x,y),B(x,)\leq I(x,y)) \quad \text{[Equation 7]}$$

In Equation 7, $B_m^{rep}$ denotes the m-th section maximum luminance control value.

When $B_m^{rep}$ is modified, it is necessary to re-adjust the backlight control value by correcting the above section luminance calculation value.

According to another aspect of the present invention, a split control method of the backlight divided into the multiple sections includes calculating the section luminance control value, which is the representative luminance value of the section, from the image signal; generating the backlight control value which is the control signal of the backlight by correcting the section luminance calculation value using the difference between the section luminance control value and the section luminance calculation value acquired from the luminance distribution value of the light source of the backlight; and adjusting the image signal using the backlight control value. The representative luminance value of the section, which is the basis of the control value, can be a maximum luminance value or an average luminance value of the section, or a certain luminance value at a specific position of the section. Hereafter, the section representative luminance value is the section maximum luminance value.

Figure 5:
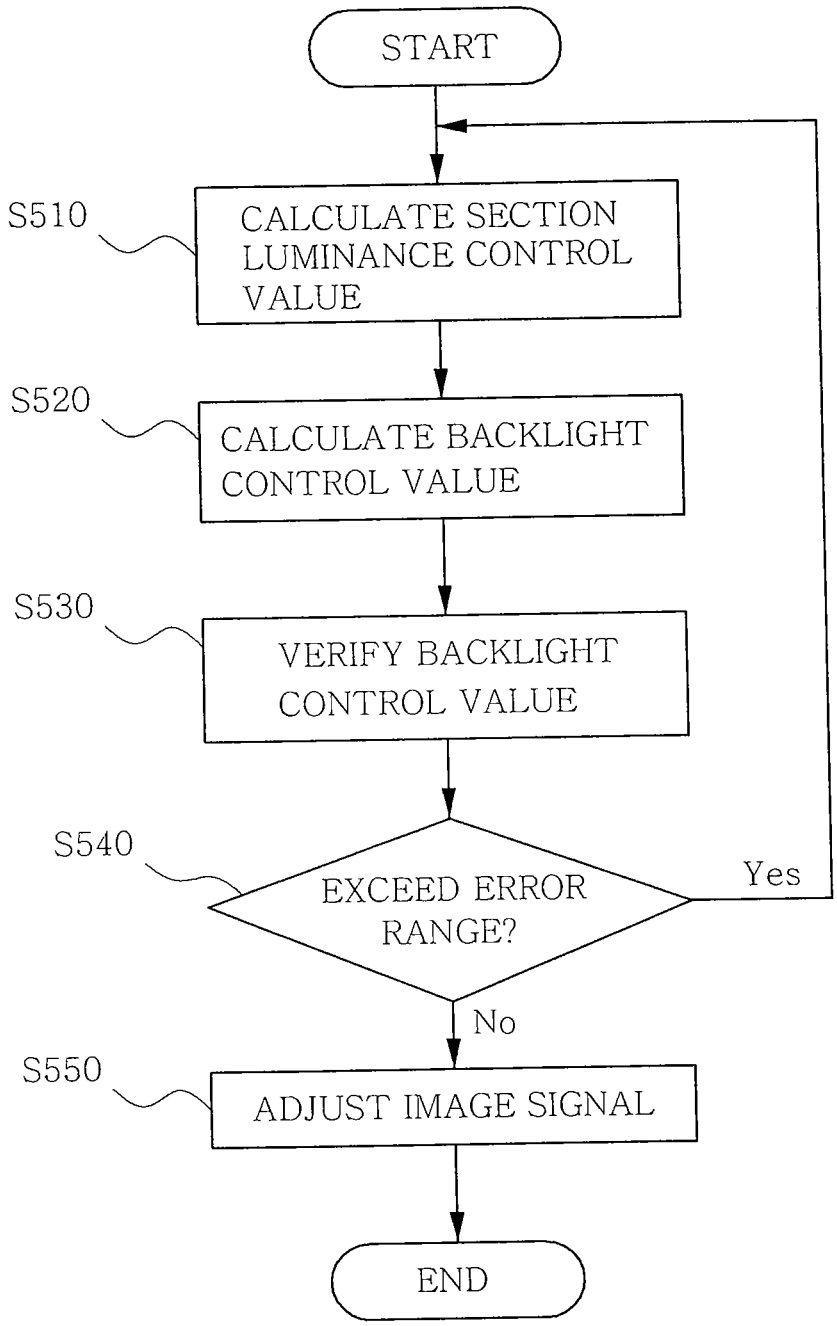
FIG. 5 is a flowchart of a backlight split control method according to an exemplary embodiment of the present invention.

FIG. 5 is a flowchart of the backlight split control method according to an exemplary embodiment of the present invention. According to the backlight split control method of FIG. 5, the section maximum luminance control value, which is the maximum value of the luminance values in a certain section, is calculated from the image signal (S510). The section maximum luminance control value is the representative control value which is a target value of the luminance value to compute, and is a reference value for correcting the section luminance calculation value.

After the section maximum luminance control value is attained, the section luminance calculation value is calculated from the luminance distribution value of the light source of the backlight. By correcting the section luminance calculation value using the difference between the section maximum luminance control value and the calculated section luminance calculation value, the backlight control value, which is the control signal of the backlight, is calculated (S520). Next, the image signal is adjusted using the backlight control signal (S550).

After the backlight control signal is computed, the backlight control signal can be verified (S530). Preferably, the verification of the backlight control value may further include determining whether the luminance calculation value at the certain coordinates (x,y) in the backlight and the required luminance value of the input image signal exceed the allowable error value or not (S540). When they exceed the allowable error (S540-Y), the backlight split control apparatus goes back to step 510 of calculating the section maximum luminance control value and repeats the computation of the backlight control value. When they do not exceed the allowable error, the image signal is adjusted using the acquired backlight control value (S550).

While it has been explained that the representative luminance value of the section is the maximum luminance value, the present invention is not limited to the maximum luminance value. Besides the maximum luminance value, the representative luminance value of the section can be the average luminance value or a luminance value at a position randomly set in the section. Accordingly, one skilled in the art should be able to understand that the present invention is applicable to other representative luminance values.

As set forth above, the adjustment value of the backlight, which is unnecessarily applied for the conventional luminance control, can be optimally modified. Therefore, the image quality can be enhanced and the efficiency of the power consumption can be raised by adjusting the luminance of the backlight using the cooperative luminance information between the divided sections of the backlight of the display device.

When the spatial and temporal filters are used after the brightness control value of the optimal efficiency is determined by considering the mutually interfering brightness of the backlight, the actually required brightness can be optimized and the spatial and temporal adverse effects caused by the section change of the backlight can be eliminated. This control method is applicable to various backlight applications.

In addition, since the distribution of the backlight is analyzed and then applied to the entire backlight system, the backlight adjustment can be appropriately applied to not only the direct type backlight but also the edge-lit type backlight. Further, the applications of the present invention can be extended to every backlight including the point light sources, and to every backlight ranging from the system where each point light resource operates to the system where the section, which is the group of the point light resources, operates.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A split control apparatus of a backlight which is divided into a plurality of sections, the apparatus comprising:

an image signal processor configured to calculate a section luminance control value which is a representative luminance value of one section of the plurality of sections, from an image signal;

a control signal generator configured to acquire a section luminance calculation value of the one section from a section luminance distribution value of a light source of the back light, correct the acquired section luminance calculation value by using a difference between the section luminance control value and the acquired section luminance calculation value, and calculate a backlight control value which is a control signal of the backlight by using the corrected section luminance calculation value, wherein the backlight control value is used to adjust a luminance of the backlight; and an image signal regulator configured to adjust the image signal by using the backlight control value.

2. The split control apparatus of claim 1, wherein the representative luminance value is a maximum luminance value or an average luminance value of the section.

3. The split apparatus of claim 2, wherein the section luminance control value is a section maximum luminance control value when the representative luminance value is the maximum luminance value of the section, and the section maximum luminance control value is expressed by the following equation:

$$B_m^{rep}=\max i|i\epsilon m\text{-th section}$$

where $B_m^{rep}$ denotes a section maximum luminance control value of an m-th section, and i ϵ m-th section denotes a luminance value in the section.

4. The split control apparatus of claim 3, wherein the section luminance calculation value is expressed by the following equation:

$$B_m(x, y) = \sum_{i=m}^{L-1} (b_i G_i(x - x_{mi}, y - y_{mi}))$$

where $B_m(x,y)$ denotes a luminance value at coordinates (x,y) in an m-th section, L denotes the number of LED sections affecting the m-th section, $b_i$ denotes a luminance control value of the m-th section when i=m, and $G_i(x-x_{mi},y-y_{mi})$ denotes a section luminance distribution value when i=m.

5. The split control apparatus of claim 3, wherein the corrected backlight control value is expressed by the following equation:

$$b_m^{[n]}=b_m^{[n-1]}+(B_m^{rep}-B^{[n-1]}(x_m,y_m))\rho_m$$

where $b_m^{[n]}$ denotes a luminance control signal value corrected for n times of an m-th section, $b_m^{[n-1]}$ denotes the luminance control signal value corrected for (n−1) times of the m-th section, $B_m^{rep}$ denotes a section maximum luminance control signal of the m-th section, $B^{[n-1]}(x_m, y_m)$ denotes a luminance value at coordinates $(x_m,y_m)$ in the m-th section with the (n−1)-time correction, and $\rho_m$ denotes a weight according to a position of the m-th section.

6. The split control apparatus of claim 5, wherein $\rho_m$ is a ratio of the number of actually affecting sections to the total number of the sections of the backlight.

7. The split control apparatus of claim 3, further comprising:

a control signal verifier configured to verify the backlight control value.

8. The split control apparatus of claim 7, wherein the control signal verifier is further configured to verify whether the backlight control value meets the following equation:

$$|B(x,y)-I(x,y)|\leq\epsilon(x,y)$$

where B(x,y), I(x,y) and $\epsilon$(x,y) denote the luminance value at the coordinates (x,y) in the backlight, a required luminance value of an input image signal, and an allowable error value respectively.

9. The split control apparatus of claim 8, wherein the control signal verifier is further configured to recalculate the backlight control signal to meet the following equation when $\oplus$B(x,y)−I(x,y)| is greater than $\epsilon$(x,y):

$$B_m^{rep}=\max(B(x,y)||B(x,y)-I(x,y)|>\epsilon(x,y),B(x,y)\leq I(x,y))$$

where $B_m^{rep}$ denotes an m-th section maximum luminance control value.

10. A split control method of a backlight which is divided into a plurality of sections, the method comprising:

calculating a section luminance control value which is a representative luminance value of one section of the plurality of sections, from an image signal;

acquiring a section luminance calculation value of the one section from a section luminance distribution value of a light source of the back light;

correcting the acquired section luminance calculation value by using a difference between the section luminance control value and the acquired section luminance calculation value, and by using the corrected section luminance calculation value;

adjusting a luminance of the backlight using the backlight control value; and adjusting the image signal by using the backlight control value.

11. The split control method of claim 10, wherein the representative luminance value is a maximum luminance value or an average luminance value of the section.

12. The split control method of claim 11, wherein the section luminance control value is a section maximum luminance control value when the representative luminance value is the maximum luminance value of the section, and when the luminance value at the certain coordinates (x, y) in the backlight and the required luminance value of the input image signal exceed the allowable error value, the backlight control value is recalculated using $B_m^{rep}$ which meets the following equation:

$$B_m^{rep}=\max(B(x,y)||B(x,y)-I(x,y)|>\epsilon(x,y),B(x,y)\leq I(x,y))$$

where B(x,y), I(x,y) and $\epsilon$(x,y) denote the luminance value at the coordinates (x,y) in the backlight, the required luminance value of the input image signal, and the allowable error value respectively, and $B_m^{rep}$ denotes an m-th section maximum luminance control value.

13. The split control method of claim 10, further comprising:

verifying the generated backlight control value.

14. The split control method of claim 13, wherein the verifying the generated backlight control value further comprises:

determining whether a luminance value at certain coordinates (x,y) in the backlight and a required luminance value of the input image signal exceed an allowable error value.

* * * * *